US010706874B2

(12) United States Patent
Jiao et al.

(10) Patent No.: US 10,706,874 B2
(45) Date of Patent: Jul. 7, 2020

(54) VOICE SIGNAL DETECTION METHOD AND APPARATUS

(71) Applicant: Alibaba Group Holding Limited, George Town (KY)

(72) Inventors: Lei Jiao, Hangzhou (CN); Yanchu Guan, Hangzhou (CN); Xiaodong Zeng, Hangzhou (CN); Feng Lin, Hangzhou (CN)

(73) Assignee: Alibaba Group Holding Limited, George Town, Grand Cayman (KY)

( * ) Notice: Subject to any disclaimer, the term of this patent is extended or adjusted under 35 U.S.C. 154(b) by 0 days.

(21) Appl. No.: 16/380,609

(22) Filed: Apr. 10, 2019

(65) Prior Publication Data

US 2019/0237097 A1 Aug. 1, 2019

Related U.S. Application Data

(63) Continuation of application No. PCT/CN2017/103489, filed on Sep. 26, 2017.

(30) Foreign Application Priority Data

Oct. 12, 2016 (CN) ..... 2016 1 0890946

(51) Int. Cl.

| | |
|---|---|
| ***G10L 25/87*** | (2013.01) |
| ***G10L 25/21*** | (2013.01) |
| ***G10L 25/84*** | (2013.01) |
| *G10L 25/78* | (2013.01) |

(52) U.S. Cl.

CPC ..... *G10L 25/87* (2013.01); *G10L 25/21* (2013.01); *G10L 25/84* (2013.01); *G10L 2025/783* (2013.01)

(58) Field of Classification Search

CPC .... G10L 25/87; G10L 25/21; G10L 2025/783
USPC ..... 704/233
See application file for complete search history.

(56) References Cited

U.S. PATENT DOCUMENTS

| | | | | |
|---|---|---|---|---|
| 9,351,089 | B1 * | 5/2016 | Chu | H04R 29/00 |
| 2004/0172244 | A1 * | 9/2004 | Oh | G10L 25/87 704/231 |
| 2005/0135431 | A1 | 6/2005 | Lam et al. | |
| 2011/0202339 | A1 | 8/2011 | Emori et al. | |
| 2011/0264449 | A1 | 10/2011 | Sehlstedt | |

(Continued)

FOREIGN PATENT DOCUMENTS

| | | |
|---|---|---|
| CN | 101494049 | 7/2009 |
| CN | 101625860 | 1/2010 |

(Continued)

OTHER PUBLICATIONS

International Search Report and Written Opinion issued in International Application No. PCT/CN2017/103489 dated Dec. 29, 2017, 15 pages (with English translation).

(Continued)

*Primary Examiner* — Edwin S Leland, III
(74) *Attorney, Agent, or Firm* — Fish & Richardson P.C.

(57) ABSTRACT

An audio signal is obtained by a user terminal. The audio signal is divided into a plurality of short-time energy frames based on a frequency of a predetermined voice signal. Energy of each short-time energy frame is determined. Based on the energy of each short-time energy frame, whether the audio signal includes a voice signal is determined.

17 Claims, 5 Drawing Sheets

(56) References Cited

U.S. PATENT DOCUMENTS

| | | | | |
|---|---|---|---|---|
| 2013/0054236 | A1 | 2/2013 | Garcia-Martinez et al. | |
| 2014/0006018 | A1* | 1/2014 | Bonada | G10L 19/265 704/208 |
| 2015/0112673 | A1* | 4/2015 | Nandy | G10L 19/002 704/233 |
| 2015/0269954 | A1* | 9/2015 | Ryan | G10L 25/78 704/233 |

FOREIGN PATENT DOCUMENTS

| | | | |
|---|---|---|---|
| CN | 102568457 | | 7/2012 |
| CN | 103117067 | | 5/2013 |
| CN | 103177722 | | 6/2013 |
| CN | 103198838 | * | 7/2013 |
| CN | 103247293 | | 8/2013 |
| CN | 103544961 | | 1/2014 |
| CN | 103646649 | * | 3/2014 |
| CN | 104916288 | | 9/2015 |
| CN | 104934032 | | 9/2015 |
| CN | 106328168 | | 1/2017 |
| CN | 106887241 | | 6/2017 |
| TW | 333610 | | 6/1998 |
| TW | 436759 | | 5/2001 |
| TW | 201320058 | | 5/2013 |
| TW | 201519222 | | 5/2015 |
| WO | WO 2011049516 | | 4/2011 |
| WO | WO 2014194273 | | 12/2014 |

OTHER PUBLICATIONS

Crosby et al., "BlockChain Technology: Beyond Bitcoin," Sutardja Center for Entrepreneurship & Technology Technical Report, Oct. 16, 2015, 35 pages.

Extemded European Search Report in European Application No. 17860814.7, dated Jul. 1, 2019, 9 pages.

Nakamoto, "Bitcoin: A Peer-to-Peer Electronic Cash System," www.bitcoin.org, 2005, 9 pages.

PCT International Preliminary Report on Patentability in International Application No. PCT/CN2017/103489, dated Apr. 16, 2019, 10 pages (with English translation).

Ravi et al., "Application of MFFC and Edge Detection for Remote Driven Vehicles through Matlab," Journal of Telematics and Informatics, 2014, 2(2):43-49.

* cited by examiner

VOICE SIGNAL DETECTION METHOD AND APPARATUS

CROSS-REFERENCE TO RELATED APPLICATIONS

This application is a continuation of PCT Application No. PCT/CN2017/103489, filed on Sep. 26, 2017, which claims priority to Chinese Patent Application No. 201610890946.9, filed on Oct. 12, 2016, and each application is hereby incorporated by reference in its entirety.

TECHNICAL FIELD

The present application relates to the field of computer technologies, and in particular, to a voice signal detection method and apparatus.

BACKGROUND

In actual life, people often use smart devices (for example, a smartphone and a tablet computer) to send voice messages. However, when using the smart devices to send the voice messages, people usually need to tap start buttons or end buttons on screens of the smart devices before sending the voice messages, and these tap operations cause much inconvenience to users.

To complete sending of the voice message without requiring the user to tap a button, the smart device needs to perform recording continuously or based on a predetermined period, and determine whether an obtained audio signal includes a voice signal. If the obtained audio signal includes a voice signal, the smart device extracts the voice signal, and then subsequently processes and sends the voice signal. As such, the smart device completes sending of the voice message.

In the existing technology, voice signal detection methods such as a dual-threshold method, a detection method based on an autocorrelation maximum value, and a wavelet transformation-based detection method are usually used to detect whether an obtained audio signal includes a voice signal. However, in these methods, frequency characteristics of audio information are usually obtained through complex calculation such as Fourier Transform, and further, it is determined, based on the frequency characteristics, whether the audio information include voice signals. Therefore, a relatively large amount of buffer data needs to be calculated, and memory usage is relatively high, so that a relatively large amount of calculation is required, a processing rate is relatively low, and power consumption is relatively large.

SUMMARY

Implementations of the present application provide a voice signal detection method and apparatus, to alleviate a problem that a processing rate is relatively low and resource consumption is relatively high in a voice signal detection method in the existing technology.

The following technical solutions are used in the implementations of the present application.

A voice signal detection method is provided, and the method includes: obtaining an audio signal; dividing the audio signal into a plurality of short-time energy frames based on a frequency of a predetermined voice signal; determining energy of each short-time energy frame; and detecting, based on the energy of each short-time energy frame, whether the audio signal includes a voice signal.

A voice signal detection apparatus is provided, and the apparatus includes: an acquisition module, configured to obtain an audio signal; a division module, configured to divide the audio signal into a plurality of short-time energy frames based on a frequency of a predetermined voice signal; a determining module, configured to determine energy of each short-time energy frame; and a detection module, configured to detect, based on the energy of each short-time energy frame, whether the audio signal includes a voice signal.

At least one of the previously described technical solutions used in the implementations of the present application can bring the following beneficial effects:

In the existing technology, it is determined, through complex calculation such as Fourier Transform, whether an audio signal includes a voice signal. In contrast, in the voice signal detection method used in the implementations of the present application, the complex calculation such as Fourier Transform does not need to be performed. The obtained audio signal is divided into the plurality of short-time energy frames based on the frequency of the predetermined voice signal, energy of each short-time energy frame is further determined, and it can be detected, based on the energy of each short-time energy frame, whether the obtained audio signal includes a voice signal. Therefore, in the voice signal detection method provided in the implementations of the present application, a problem that a processing rate is relatively low and resource consumption is relatively high in a voice signal detection method in the existing technology can be alleviated.

BRIEF DESCRIPTION OF DRAWINGS

The accompanying drawings described here are intended to provide a further understanding of the present application, and constitute a part of the present application. The illustrative implementations of the present application and descriptions thereof are intended to describe the present application, and do not constitute limitations on the present application. Description of the accompanying drawings is as follows.

DESCRIPTION OF IMPLEMENTATIONS

To make the objectives, technical solutions, and advantages of the present application clearer, the following clearly and comprehensively describes the technical solutions of the present application with reference to implementations and accompanying drawings of the present application. Apparently, the described implementations are merely some rather than all of the implementations of the present application.

All other implementations obtained by a person of ordinary skill in the art based on the implementations of the present application without creative efforts shall fall within the protection scope of the present application.

The technical solutions provided in the implementations of the present application are described in detail below with reference to the accompanying drawings.

To alleviate a problem that a processing rate is relatively low and resource consumption is relatively high in a voice signal detection method in the existing technology, an implementation of the present application provides a voice signal detection method.

An execution body of the method may be, but is not limited to a user terminal such as a mobile phone, a tablet computer, or a personal computer (Personal Computer, PC), may be an application (application, APP) running on these user terminals, or may be a device such as a server.

For ease of description, an example in which the execution body of the method is an APP is used below to describe an implementation of the method. It can be understood that the method is executed by the APP, and this is only an example for description, and should not be construed as a limitation on this method.

Figure 1:
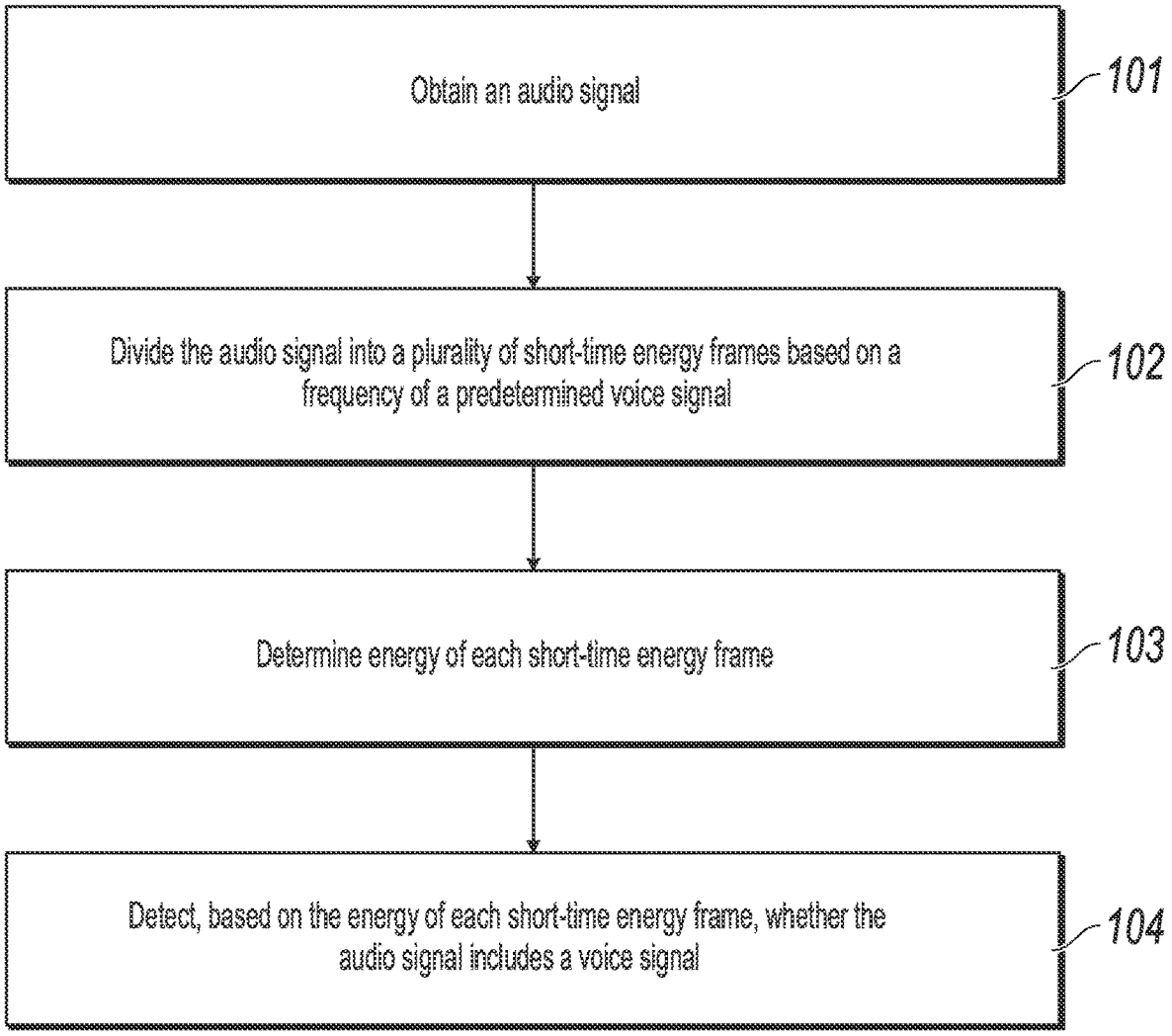
FIG. 1 is a flowchart illustrating a voice signal detection method, according to an implementation of the present application.

FIG. 1 is a schematic diagram of a procedure of the method. The method includes the steps below.

Step 101: Obtain an audio signal.

The audio signal may be an audio signal collected by the APP by using an audio collection device, or may be an audio signal received by the APP, for example, may be an audio signal transmitted by another APP or a device. Implementations are not limited in the present application. After obtaining the audio signal, the APP can locally store the audio signal.

The present application also imposes no limitation on a sampling rate, duration, a format, a sound channel, or the like that corresponds to the audio signal.

The APP may be any type of APP, such as a chat APP or a payment APP, provided that the APP can obtain the audio signal and can perform voice signal detection on the obtained audio signal in the voice signal detection method provided in the present implementation of the present application.

Step 102: Divide the audio signal into a plurality of short-time energy frames based on a frequency of a predetermined voice signal.

The short-time energy frame is actually a part of the audio signal obtained in step 101.

Specifically, a period of the predetermined voice signal can be determined based on a frequency of the predetermined voice signal, and based on the determined period, the audio signal obtained in step 101 is divided into the plurality of short-time energy frames whose corresponding duration is the period. For example, assuming that the period of the predetermined voice signal is 0.01 s, based on duration of the audio signal obtained in step 101, the audio signal can be divided into several short-time energy frames whose duration is 0.01 s. It is worthwhile to note that, when the audio signal obtained in step 101 is divided, the audio signal may alternatively be divided into at least two short-time energy frames based on an actual condition and the frequency of the predetermined voice signal. For ease of subsequent description, an example in which the audio signal is divided into the plurality of short-time energy frames is used for description below in the present implementation of the present application.

In addition, when the APP collects the audio signal by using the audio collection device in step 101, because collecting the audio signal is generally collecting, at a certain sampling rate, an audio signal that is actually an analog signal to form a digital signal, namely, an audio signal in a pulse code modulation (Pulse Code Modulation, PCM) format, the audio signal can be further divided into the plurality of short-time energy frames based on the sampling rate of the audio signal and the frequency of the predetermined voice signal.

Specifically, a ratio m of the sampling rate of the audio signal to the frequency of the predetermined voice signal can be determined, and then each m sampling points in the collected digital audio signal are grouped into one short-time energy frame base on the ratio m. If m is a positive integer, the audio signal may be divided into a maximum quantity of short-time energy frames based on m; or if m is not a positive integer, the audio signal may be divided into a maximum quantity of short-time energy frames based on m that is rounded to a positive integer. It is worthwhile to note that, if the quantity of sampling points included in the audio signal obtained in step 101 is not an integer multiple of m, after the audio signal is divided into the maximum quantity of short-time energy frames, the remaining sampling points may be discarded, or the remaining sampling points may alternatively be used as a short-time energy frame for subsequent processing. M is used to denote a quantity of sampling points included in the audio signal obtained in step 101 in the period of the predetermined voice signal.

For example, if the frequency of the predetermined voice signal is 82 Hz, duration of the audio signal obtained in step 101 is 1 s, and the sampling rate is 16000 Hz, m=16000/82=195.1. Because m is not a positive integer here, 195.1 is rounded to a positive integer 195. Based on the duration and the sampling rate of the audio signal, it may be determined that the quantity of sampling points included in the audio signal is 16000. Because the quantity of sampling points included in the audio signal is not an integer multiple of 195, after the audio signal is divided into 82 short-time energy frames, the remaining 10 sampling points may be discarded. The quantity of sampling points included in each short-time energy frame is 195.

When the audio signal obtained in step 101 is a received audio signal transmitted by another APP or a device, the audio signal may be divided into a plurality of short-time energy frames by using any one of the previous methods. It is worthwhile to note that the format of the audio signal may not be the PCM format. If the short-time energy frame is obtained by performing division in the previous method based on the sampling rate of the audio signal and the frequency of the predetermined voice signal, the received audio signal needs to be converted into the audio signal in the PCM format. In addition, when the audio signal is received, the sampling rate of the audio signal needs to be identified. A method for identifying the sampling rate of the audio signal may be an identification method in the existing technology. Details are omitted here for simplicity.

Step 103: Determine energy of each short-time energy frame.

In the present implementation of the present application, when the audio signal in the PCM format is divided, in the previous method, into several short-time energy frames that are also in the PCM format, the energy of the short-time energy frame can be determined based on an amplitude of an audio signal that corresponds to each sampling point in the short-time energy frame. Specifically, energy of each sampling point can be determined based on the amplitude of the audio signal that corresponds to each sampling point in the short-time energy frame, and then energy of the sampling points is added up. A finally obtained sum of energy is used as the energy of the short-time energy frame.

For example, the energy of the short-time energy frame can be determined by using following equation:

$$\text{Energy} = \sum_{i}^{i+n} (A_i[t])^2,$$

where i represents an ith sampling point of the audio signal, n is the quantity of sampling points included in the short-time energy frame, $A_i$ [t] is an amplitude of an audio signal that corresponds to the ith sampling point, and a value range of an amplitude of the short-time energy frame is from −32768 to 32767.

In addition, in the present implementation of the present application, to simplify calculation and save resources, a value obtained by dividing an amplitude by 32768 can be further used as a normalized amplitude of the short-time energy frame. The amplitude is obtained when the audio signal is collected. A value range of the normalized amplitude of the short-time energy frame is from −1 to 1.

If the short-time energy frame is not in the PCM format, an amplitude calculation function can be determined based on an amplitude of the short-time energy frame at each moment, and integration is performed on a square of the function, and a finally obtained integral result is the energy of the short-time energy frame.

Step 104: Detect, based on the energy of each short-time energy frame, whether the audio signal includes a voice signal.

Specifically, the following two methods may be used to determine whether the audio signal includes a voice signal.

Method 1: A ratio of a quantity of short-time energy frames whose energy is greater than a predetermined threshold to a total quantity of all short-time energy frames (referred to as a high-energy frame ratio below) is determined, and it is determined whether the determined high-energy frame ratio is greater than the predetermined ratio. If yes, it is determined that the audio signal includes a voice signal; or if no, it is determined that the audio signal does not include a voice signal.

A value of the predetermined threshold and a value of the predetermined ratio can be set based on an actual demand. In the present implementation of the present application, the predetermined threshold can be set to 2, and the predetermined ratio can be set to 20%. If the high-energy frame ratio is greater than 20%, it is determined that the audio signal includes a voice signal; otherwise, it is determined that the audio signal does not include a voice signal.

In the present implementation of the present application, because there is some noise in an external environment in actual life when people talk, and noise generally has lower energy than voice of the people, Method 1 can be used to determine whether the audio signal includes a voice signal. In this case, if an audio signal segment includes short-time energy frames whose energy is greater than the predetermined threshold, and these short-time energy frames make up a certain ratio of the audio signal segment, it may be determined that the audio signal includes a voice signal.

Method 2: To make a final detection result more accurate, Method 1 may be used to determine a high-energy frame ratio and determine whether the determined high-energy frame ratio is greater than a predetermined ratio. If no, it is determined that the audio signal does not include a voice signal; or if yes, when there are at least N consecutive short-time energy frames in the short-time energy frames whose energy is greater than the predetermined threshold, it is determined that the audio signal includes a voice signal; or when there are not at least N consecutive short-time energy frames in the short-time energy frames whose energy is greater than the predetermined threshold, it is determined that the audio signal does not include a voice signal. N may be any positive integer. In the present implementation of the present application, N may be set to 10.

To be specific, based on Method 1, in Method 2, the following requirement is added for determining whether an audio signal includes a voice signal: It is determined whether there are at least N consecutive short-time energy frames in short-time energy frames whose energy is greater than a predetermined threshold. As such, noise can be effectively reduced. In actual life, the noise has lower energy than voice of the people and audio signals are random, in Method 2, a case in which the audio signal includes excessive noise can be effectively excluded, and impact of noise in an external environment is reduced, to achieve a noise reduction function.

It is worthwhile to note that the voice signal detection method provided in the present implementation of the present application may be applied to detection of a mono audio signal, a binaural audio signal, a multichannel audio signal, or the like. An audio signal collected by using one sound channel is a mono audio signal; an audio signal collected by using two sound channels is a binaural audio signal; and an audio signal collected by using a plurality of sound channels is a multichannel audio signal.

When a binaural audio signal and a multichannel audio signal are detected in the method shown in FIG. 1, an obtained audio signal of each channel may be detected by performing the operations mentioned in step 101 to step 104, and finally, it is determined, based on a detection result of the audio signal of each channel, whether the obtained audio signal includes a voice signal.

Specifically, if the audio signal obtained in step 101 is a mono audio signal, the operations mentioned in step 101 to step 104 can be directly performed on the audio signal, and a detection result is used as a final detection result.

If the audio signal obtained in step 101 is a binaural audio signal or a multichannel audio signal instead of a mono audio signal, the audio signal of each channel can be processed by performing the operations mentioned in step 101 to step 104. If it is detected that the audio signal of each channel does not include a voice signal, it is determined that the audio signal obtained in step 101 does not include a voice signal. If it is detected that an audio signal of at least one channel includes a voice signal, it is determined that the audio signal obtained in step 101 includes a voice signal.

In addition, a frequency of the predetermined voice signal mentioned in step 102 can be a frequency of any voice. Implementations are not limited in the present application. In practice, based on an actual case, different frequencies of predetermined voice signals can be set for different audio signals obtained in step 101. It is worthwhile to note that the frequency of the predetermined voice signal can be a frequency of any voice signal, such as a voice frequency of a soprano or a voice frequency of a bass, provided that a short-time energy frame that is finally obtained through division satisfies the following requirement: Duration that corresponds to a short-time energy frame is not less than a period that corresponds to the audio signal obtained in step 101. To ensure a better detection effect, save as many resources as possible, and improve a processing rate, in the present implementation of the present application, the frequency of the predetermined voice signal can be set to a minimum human voice frequency, namely, 82 Hz. Because the period is a reciprocal of the frequency, if the frequency of the predetermined voice signal is the minimum human voice frequency, the period of the predetermined voice signal is a maximum human voice period. Therefore, regardless of a period of the audio signal obtained in step 101, duration that corresponds to the short-time energy frame is not less than the period of the previously obtained audio signal.

It is worthwhile to note that, in the present implementation of the present application, because the detection method discussed herein is used to determine whether an audio signal includes a voice signal based on a feature of voice of a human being, it is required that the duration that corresponds to the short-time energy frame be not less than the period of the audio signal obtained in step 101. Compared with noise, the voice of the human being has higher energy, is more stable, and is continuous. If the duration that corresponds to the short-time energy frame is less than the period of the audio signal obtained in step 101, waveforms that correspond to the short-time energy frame do not include a waveform of a complete period, and the duration of the short-time energy frame is relatively short. In this case, even if the high-energy frame ratio is greater than the predetermined ratio, and there are at least N consecutive short-time energy frames in the short-time energy frames whose energy is greater than the predetermined threshold, it only indicates that the audio signal includes a sound signal, but does not indicate that the sound signal is a voice signal. Therefore, in the present implementation of the present application, duration of the audio signal obtained in step 101 should be greater than a maximum human voice period.

Figure 2:
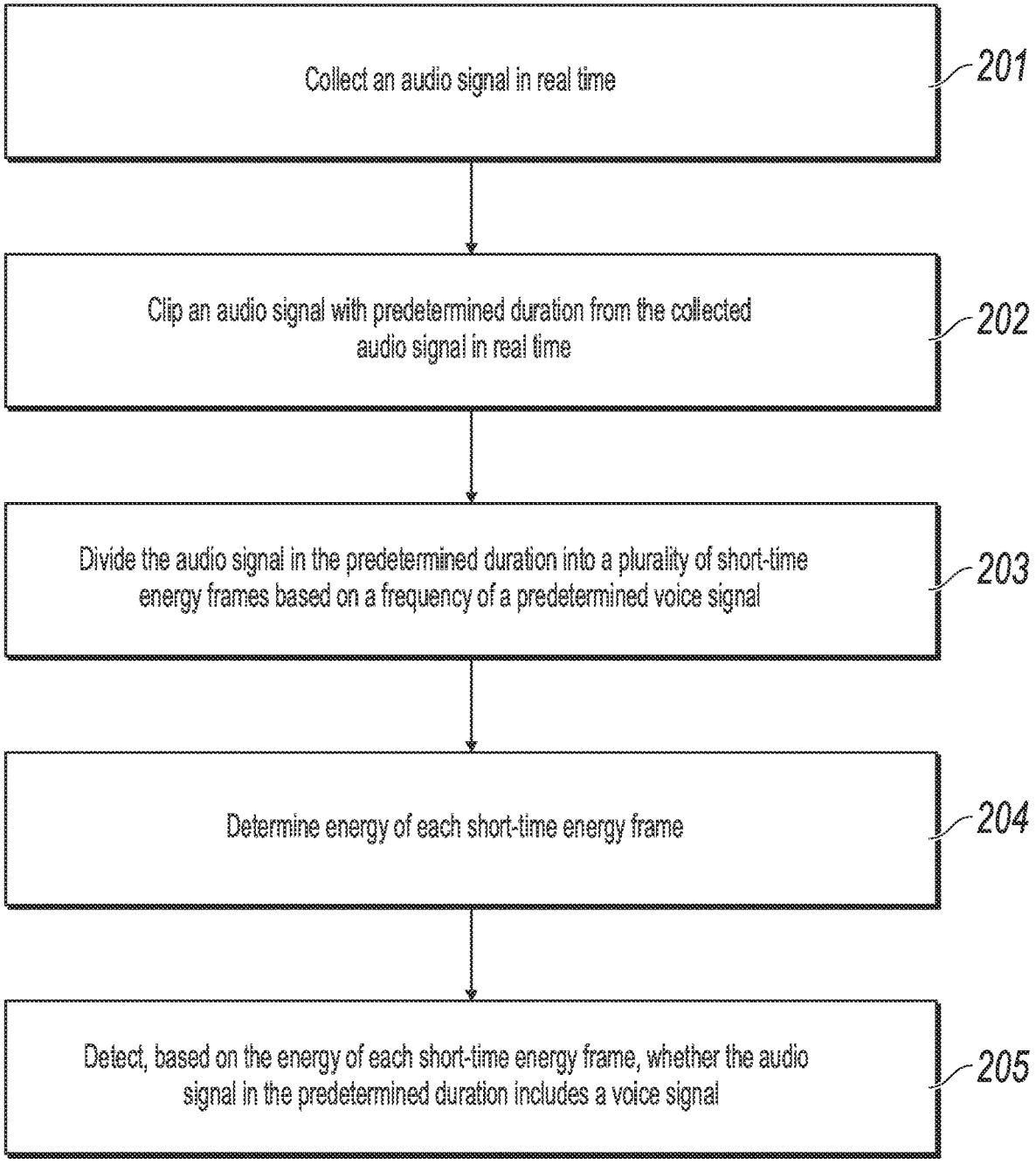
FIG. 2 is a flowchart illustrating another voice signal detection method, according to an implementation of the present application.

In addition, the voice signal detection method provided in the present implementation of the present application is particularly applicable to an application scenario in which sending of a voice message can be completed by using a chat APP without any tap operation of a user. Based on the scenario, the following describes in detail the voice signal detection method provided in the present implementation of the present application. In this scenario, FIG. 2 is a schematic diagram of a procedure of the method. The method includes the steps below.

Step 201: Collect an audio signal in real time.

The user may expect the chat APP to complete sending of the voice message without any tap operation after the user starts the APP. In this case, the APP continuously records the external environment to collect the audio signal in real time, to reduce omission of voice of the user. In addition, after collecting the audio signal, the APP can locally store the audio signal in real time. After the user stops the APP, the APP stops recording.

Step 202: Clip an audio signal with predetermined duration from the collected audio signal in real time.

If the APP keeps recording instead of detecting a voice signal in real time, the voice message is not sent in real time. Therefore, the APP can clip, in real time, the audio signal with the predetermined duration from the audio signal collected in step 201, and perform subsequent detection on the audio signal with the predetermined duration.

The currently clipped audio signal with the predetermined duration can be referred to as a current audio signal, and a last clipped audio signal with the predetermined duration can be referred to as a last obtained audio signal.

Step 203: Divide the audio signal in the predetermined duration into a plurality of short-time energy frames based on a frequency of a predetermined voice signal.

Step 204: Determine energy of each short-time energy frame.

Step 205: Detect, based on the energy of each short-time energy frame, whether the audio signal in the predetermined duration includes a voice signal.

If it is detected that the current audio signal includes a voice signal, it is determined whether the last obtained audio signal includes a voice signal. If it is determined that the last obtained audio signal does not include a voice signal, a start point of the current audio signal can be determined as a start point of the voice signal; or if it is determined that the last obtained audio signal includes a voice signal, a start point of the current audio signal is not a start point of the voice signal.

If it is detected that the current audio signal does not include a voice signal, it is determined whether the last obtained audio signal includes a voice signal. If it is determined that the last obtained audio signal includes a voice signal, an end point of the last obtained audio signal can be determined as an end point of the voice signal; or if it is determined that the last obtained audio signal does not include a voice signal, neither an end point of the current audio signal nor an end point of the last obtained audio signal is an end point of the voice signal.

Figure 3:
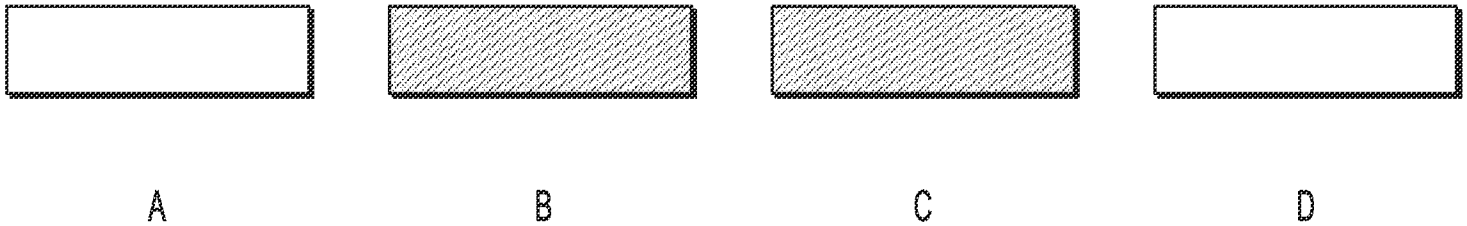
FIG. 3 is a display diagram illustrating an audio signal of predetermined duration, according to an implementation of the present application.

For example, as shown in FIG. 3, A, B, C, and D are four adjacent audio signals with predetermined duration. A and D do not include a voice signal, and B and C include voice signals. In this case, a start point of B can be determined as a start point of the voice signal, and an end point of C can be determined as an end point of the voice signal.

Sometimes the current audio signal happens to be a start part or an end part of a sentence of the user, and the audio signal includes a few voice signals. In this case, the APP may incorrectly determine that the audio signal does not include a voice signal. To reduce omission of voice of the user because of incorrect determining, after it is detected that the current audio signal includes a voice signal, it can be determined whether the last obtained audio signal includes a voice signal; and if it is determined that the last obtained audio signal does not include a voice signal, a start point of the last obtained audio signal can be determined as a start point of the voice signal. In addition, after it is detected that the current audio signal does not include a voice signal, it can be determined whether the last obtained audio signal includes a voice signal; and if it is determined that the last obtained audio signal includes a voice signal, an end point of the current audio signal can be determined as an end point of the voice signal. In the previous example, a start point of A can be determined as the start point of the voice signal, and an end point of D can be determined as the end point of the voice signal.

After detecting that the current audio signal includes a voice signal, the APP can send the audio signal to a voice identification apparatus, so that the voice identification apparatus can perform voice processing on the audio signal, to obtain a voice result. Then, the voice identification apparatus sends the audio signal to a subsequent processing apparatus, and finally the audio signal is sent in a form of a voice message. To ensure that voice of the user in the sent voice message is a complete sentence, after sending all audio signals between the determined start point and the determined end point of the voice signal to the voice identification apparatus, the APP can send an audio stop signal to the voice identification apparatus, to inform the voice identification apparatus that this sentence currently said by the user is completed, so that the voice identification apparatus sends all the audio signals to the subsequent processing apparatus. Finally, the audio signals are sent in the form of the voice message.

In addition, to ensure accurate determining, after the current audio signal is obtained, a sub-signal with a predetermined time period can be further clipped from the last obtained audio signal, and the current audio signal and the clipped sub-signal are concatenated, to serve as the obtained audio signal (referred to as a concatenated audio signal below). In addition, subsequent voice signal detection is performed on the concatenated audio signal.

The sub-signal can be concatenated before the current audio signal. The predetermined time period can be a tail time period of the last obtained audio signal, and duration that corresponds to the time period can be any duration. To ensure that a final detection result is more accurate, in the present implementation of the present application, the duration that corresponds to the predetermined time period can be set to a value that is not greater than a product of the predetermined ratio and duration that corresponds to the concatenated audio signal.

If it is detected that the concatenated audio signal includes a voice signal, it can be determined whether the last obtained concatenated audio signal includes a voice signal. If it is determined that the last obtained concatenated audio signal does not include a voice signal, a start point of the concatenated audio signal can be used as a start point of the voice signal. If it is detected that the concatenated audio signal does not include a voice signal, it can be determined whether the last obtained concatenated audio signal includes a voice signal. If it is determined that the last obtained concatenated audio signal includes a voice signal, an end point of the concatenated audio signal can be used as an end point of the voice signal.

In the present implementation of the present application, in addition to continuous recording, the APP can periodically perform recording. Implementations are not limited in the present implementation of the present application.

Figure 4:
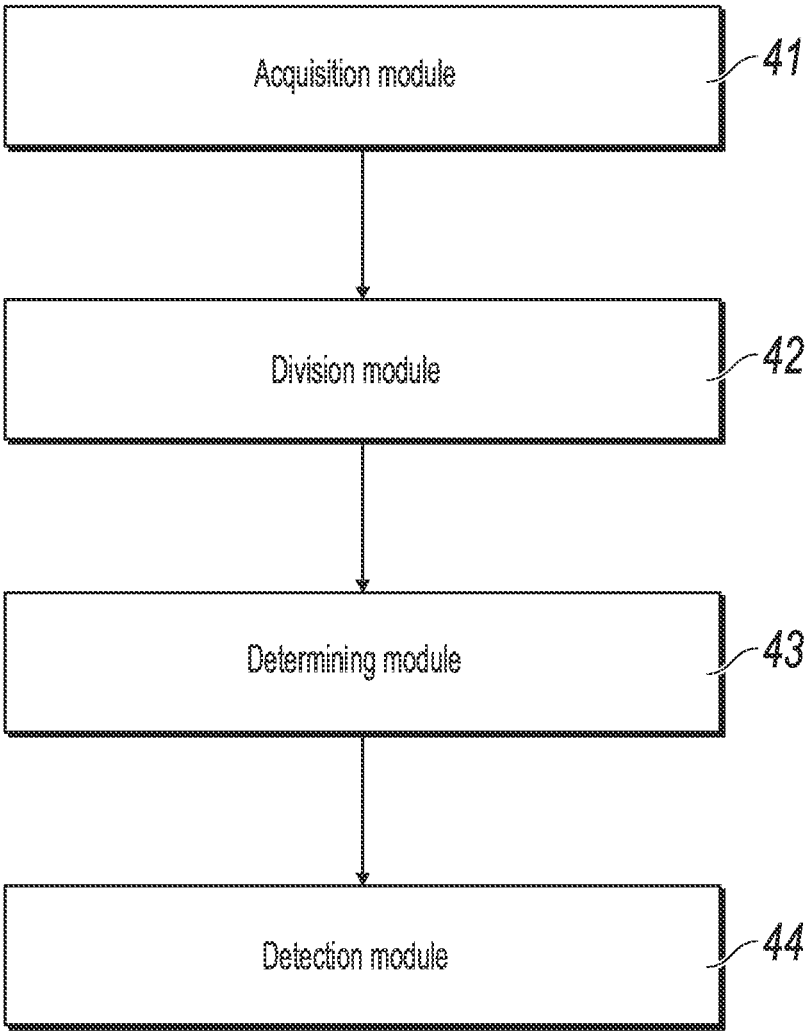
FIG. 4 is a schematic diagram illustrating a structure of a voice signal detection apparatus, according to an implementation of the present application.

The voice signal detection method provided in the present implementation of the present application can be further implemented by using a voice signal detection apparatus. A schematic structural diagram of the apparatus is shown in FIG. 4. The voice signal detection apparatus mainly includes the following modules: an acquisition module 41, configured to obtain an audio signal; a division module 42, configured to divide the audio signal into a plurality of short-time energy frames based on a frequency of a predetermined voice signal; a determining module 43, configured to determine energy of each short-time energy frame; and a detection module 44, configured to detect, based on the energy of each short-time energy frame, whether the audio signal includes a voice signal.

In an implementation, the acquisition module 41 is configured to: obtain a current audio signal; clip a sub-signal with a predetermined time period from a last obtained audio signal; and concatenate the current audio signal and the clipped sub-signal, to serve as the obtained audio signal.

In an implementation, the division module 42 is configured to determine a period of the predetermined voice signal based on the frequency of the predetermined voice signal; and divide, based on the determined period, the audio signal into a plurality of short-time energy frames whose corresponding duration is the period.

In an implementation, the detection module 44 is configured to determine a ratio of a quantity of short-time energy frames whose energy is greater than a predetermined threshold to a total quantity of all short-time energy frames; determine whether the ratio is greater than a predetermined ratio; and if yes, determine that the audio signal includes a voice signal; or if no, determine that the audio signal does not include a voice signal.

In an implementation, the detection module 44 is configured to determine a ratio of a quantity of short-time energy frames whose energy is greater than a predetermined threshold to a total quantity of all short-time energy frames; determine whether the ratio is greater than a predetermined ratio; and if no, determine that the audio signal does not include a voice signal; or if yes, when there are at least N consecutive short-time energy frames in the short-time energy frames whose energy is greater than the predetermined threshold, determine that the audio signal includes a voice signal; or when there are not at least N consecutive short-time energy frames in the short-time energy frames whose energy is greater than the predetermined threshold, determine that the audio signal does not include a voice signal.

In the existing technology, it is determined, through complex calculation such as Fourier Transform, whether an audio signal includes a voice signal. In contrast, in the voice signal detection method used in the implementations of the present application, the complex calculation such as Fourier Transform does not need to be performed. The obtained audio signal is divided into the plurality of short-time energy frames based on the frequency of the predetermined voice signal, energy of each short-time energy frame is further determined, and it can be detected, based on the energy of each short-time energy frame, whether the obtained audio signal includes a voice signal. Therefore, in the voice signal detection method provided in the implementations of the present application, a problem that a processing rate is relatively low and resource consumption is relatively high in a voice signal detection method in the existing technology can be alleviated.

The present disclosure is described with reference to the flowcharts and/or block diagrams of the method, the device (system), and the computer program product based on the implementations of the present disclosure. It is worthwhile to note that computer program instructions can be used to implement each process and/or each block in the flowcharts and/or the block diagrams and a combination of processes and/or blocks in the flowcharts and/or the block diagrams. These computer program instructions can be provided for a general-purpose computer, a dedicated computer, an embedded processor, or a processor of another programmable data processing device to generate a machine, so that the instructions executed by the computer or the processor of the another programmable data processing device generate a device for implementing a specified function in one or more processes in the flowcharts and/or in one or more blocks in the block diagrams.

These computer program instructions can be stored in a computer readable memory that can instruct the computer or the another programmable data processing device to work in a way, so that the instructions stored in the computer readable memory generate an artifact that includes an instruction device. The instruction device implements a specified function in one or more processes in the flowcharts and/or in one or more blocks in the block diagrams.

These computer program instructions can be loaded onto the computer or the another programmable data processing device, so that a series of operations and steps are performed on the computer or the another programmable device, thereby generating computer-implemented processing. Therefore, the instructions executed on the computer or the another programmable device provide steps for implementing a specified function in one or more processes in the flowcharts and/or in one or more blocks in the block diagrams.

In a typical configuration, a calculation device includes one or more central processing units (CPUs), one or more input/output interfaces, one or more network interfaces, and one or more memories.

The memory can include a non-persistent memory, a random access memory (RAM), a non-volatile memory, and/or another form that are in a computer readable medium, for example, a read-only memory (ROM) or a flash memory (flash RAM). The memory is an example of the computer readable medium.

The computer readable medium includes persistent, non-persistent, movable, and unmovable media that can store information by using any method or technology. The information can be a computer readable instruction, a data structure, a program module, or other data. Examples of a computer storage medium include but are not limited to a phase-change random access memory (PRAM), a static random access memory (SRAM), a dynamic random access memory (DRAM), another type of random access memory (RAM), a read-only memory (ROM), an electrically erasable programmable read-only memory (EEPROM), a flash memory or another memory technology, a compact disc read-only memory (CD-ROM), a digital versatile disc (DVD) or another optical storage, a cassette magnetic tape, a magnetic tape/magnetic disk storage, another magnetic storage device, or any other non-transmission medium. The computer storage medium can be configured to store information accessible to the calculation device. Based on the definition in the present specification, the computer readable medium does not include transitory computer readable media (transitory media) such as a modulated data signal and carrier.

It is worthwhile to further note that the term "include", "contain", or their any other variant is intended to cover a non-exclusive inclusion, so that a process, a method, merchandise, or a device that includes a list of elements not only includes those elements but also includes other elements which are not expressly listed, or further includes elements inherent to such process, method, merchandise, or device. An element preceded by "includes a . . . " does not, without more constraints, preclude the existence of additional identical elements in the process, method, merchandise, or device that includes the element.

A person skilled in the art should understand that the implementations of the present application can be provided as a method, a system, or a computer program product. Therefore, the present application can use a form of hardware only implementations, software only implementations, or implementations with a combination of software and hardware. In addition, the present application can use a form of a computer program product implemented on one or more computer-usable storage media (including but not limited to a disk memory, a CD-ROM, an optical memory, etc.) that include computer-usable program code.

The previous implementations are implementations of the present application, and are not intended to limit the present application. A person skilled in the art can make various modifications and changes to the present application. Any modification, equivalent replacement, or improvement made without departing from the spirit and principle of the present application shall fall within the scope of the claims in the present application.

Figure 5:
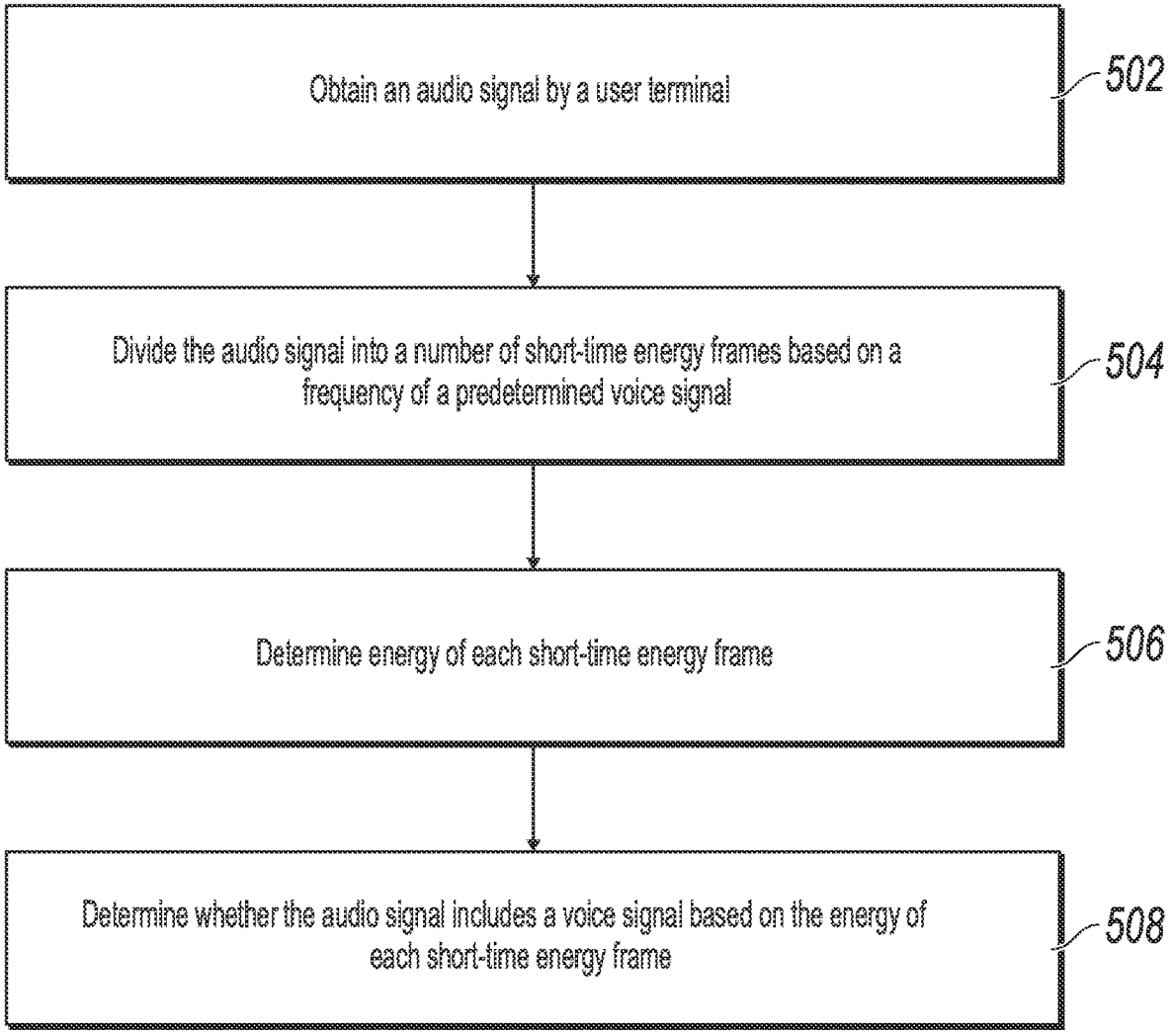
FIG. 5 is a flowchart illustrating an example of a computer-implemented method for detecting a voice signal from audio data information, according to an implementation of the present disclosure.

FIG. 5 is a flowchart illustrating an example of a computer-implemented method 500 for detecting a voice signal from audio data information, according to an implementation of the present disclosure. For clarity of presentation, the description that follows generally describes method 500 in the context of the other figures in this description. However, it will be understood that method 500 can be performed, for example, by any system, environment, software, and hardware, or a combination of systems, environments, software, and hardware, as appropriate. In some implementations, various steps of method 500 can be run in parallel, in combination, in loops, or in any order.

At 502, an audio signal (or data) is obtained by a user terminal. From 502, method 500 proceeds to 504.

At 504, the audio signal is divided into a number of short-time energy frames based on a frequency of a predetermined voice signal. In some implementations, the audio signal is collected at a sampling rate and is in a pulse code modulation (PCM) format, where the obtained audio signal is divided into the number of short-time energy frames also based on the sampling rate.

In some implementations, the obtained audio signal is in a non-PCM format. Prior to dividing the audio signal, the audio signal is converted into a pulse code modulation (PCM) format and a sampling rate of the audio signal is identified.

In some implementations, dividing the audio signal includes determining a period associated with the predetermined voice signal based on a frequency associated with the predetermined voice signal and dividing the audio signal into a number of short-time energy frames also based on the determined period. From 504, method 500 proceeds to 506.

At 506, by the user terminal, energy of each short-time energy frame is determined. In some implementations, the energy of each short-time energy frame is a sum of energy associated with each sampling point in each short-time energy frame, where the energy associated with each sampling point is determined based on an amplitude of the audio signal that corresponds to the sampling point in the short-time energy frame. From 506, method 500 proceeds to 508.

At 508, whether the audio signal includes a voice signal is determined based on the energy of each short-time energy frame.

In some implementations, determining whether the audio signal includes a voice signal includes, determining a number of high-energy frames, wherein each high-energy frame of the plurality of high-energy frames is a short-time energy frame, where energy is greater than a predetermined threshold. A high-energy frame ratio is determined, the high-energy frame ratio is represented by a ratio of a quantity of the number of high-energy frames to a quantity of the short-time energy frames included in the audio signal. Whether the high-energy frame ratio is greater than a predetermined value is determined. If it is determined that the high-energy frame ratio is greater than the predetermined value, that the audio signal includes a voice signal is determined. If it is determined that the high-energy frame ratio is not greater than the predetermined value, that the audio signal does not include a voice signal is determined.

In some implementations, where it is determined that the high-energy frame ratio is greater than the predetermined value, method 500 further includes determining, from the short-time energy frames included in the audio signal, whether there exist a predetermined number of consecutive short-time energy frames, where each of the predetermined number of consecutive short-time energy frame has energy that is greater than the predetermined threshold. If the determination is YES, determining that the audio signal includes a voice signal is determined. Otherwise, that the audio signal does not include a voice signal is determined. After 508, method 500 can stop.

Implementations of the present application can provide one or more technical effects and solve one or more technical problems in detecting a voice signal from audio signals. In conventional methods, a voice signal in audio signals can be detected by detection methods such as a dual-threshold method that is based on an autocorrelation maximum value and a wavelet transformation-based detection method. However, in these methods, whether the audio signals include a voice signal is determined based on frequency characteristics of audio information, which are usually obtained through complex calculations (such as, a Fourier Transform). As such, these methods can require a large amount of buffer data to be calculated and high computer memory usage in one or more computers. The complex calculations, calculation of buffer data, and high computer memory usage can result in, among other things, a reduced computer processing rate, higher power consumption, reduction of available computer memory, and an increase of needed time to complete computer operations. What is needed is a technique to bypass conventional method drawbacks and to provide a more accurate and efficient solution for detecting a voice signal from audio signals.

Implementation of the present application provide methods and apparatuses for improving the processing rate and computing resource consumption in voice signal detection. According to these implementations, an audio signal (for example, received by a smart mobile computing device) is divided into a number of short-time energy frames based on a frequency of a predetermined voice signal, and energy of each short-time energy frame is also determined. Compared with noise in the external environment when people talk, a human voice has higher energy, is more stable, and is continuous. Therefore, if an audio signal segment includes short-time energy frames with energy greater than a predetermined threshold, and the short-time energy frames make up a certain ratio of the audio signal segment, it can be determined that the audio signal includes a voice signal. To enhance detection, to save computing resources, and to improve computer processing rates, in some implementations, a frequency of the predetermined voice signal can be set to a minimum human voice frequency.

Additionally, the described voice signal detection method is particularly applicable to an application scenario in which sending a voice message can be completed by using a chat APP without any manual (for example, a tap) operation performed by a user. In this scenario, the smart device records a continuous audio signal received externally from a user and determines the recorded audio signal includes a voice signal. The voice signal can be automatically extracted, processed, and sent. As such, a smart device can send the voice message without requiring a manual user action (for example, a tap) to start/end a recording.

Embodiments and the operations described in this specification can be implemented in digital electronic circuitry, or in computer software, firmware, or hardware, including the structures disclosed in this specification or in combinations of one or more of them. The operations can be implemented as operations performed by a data processing apparatus on data stored on one or more computer-readable storage devices or received from other sources. A data processing apparatus, computer, or computing device may encompass apparatus, devices, and machines for processing data, including by way of example a programmable processor, a computer, a system on a chip, or multiple ones, or combinations, of the foregoing. The apparatus can include special purpose logic circuitry, for example, a central processing unit (CPU), a field programmable gate array (FPGA) or an application-specific integrated circuit (ASIC). The apparatus can also include code that creates an execution environment for the computer program in question, for example, code that constitutes processor firmware, a protocol stack, a database management system, an operating system (for example an operating system or a combination of operating systems), a cross-platform runtime environment, a virtual machine, or a combination of one or more of them. The apparatus and execution environment can realize various different computing model infrastructures, such as web services, distributed computing and grid computing infrastructures.

A computer program (also known, for example, as a program, software, software application, software module, software unit, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A program can be stored in a portion of a file that holds other programs or data (for example, one or more scripts stored in a markup language document), in a single file dedicated to the program in question, or in multiple coordinated files (for example, files that store one or more modules, sub-programs, or portions of code). A computer program can be executed on one computer or on multiple computers that are located at one site or distributed across multiple sites and interconnected by a communication network.

Processors for execution of a computer program include, by way of example, both general- and special-purpose microprocessors, and any one or more processors of any kind of digital computer. Generally, a processor will receive instructions and data from a read-only memory or a random-access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data. A computer can be embedded in another device, for example, a mobile device, a personal digital assistant (PDA), a game console, a Global Positioning System (GPS) receiver, or a portable storage device. Devices suitable for storing computer program instructions and data include non-volatile memory, media and memory devices, including, by way of example, semiconductor memory devices, magnetic disks, and magneto-optical disks. The processor and the memory can be supplemented by, or incorporated in, special-purpose logic circuitry.

Mobile devices can include handsets, user equipment (UE), mobile telephones (for example, smartphones), tablets, wearable devices (for example, smart watches and smart eyeglasses), implanted devices within the human body (for example, biosensors, cochlear implants), or other types of mobile devices. The mobile devices can communicate wirelessly (for example, using radio frequency (RF) signals) to various communication networks (described below). The mobile devices can include sensors for determining characteristics of the mobile device's current environment. The sensors can include cameras, microphones, proximity sensors, GPS sensors, motion sensors, accelerometers, ambient light sensors, moisture sensors, gyroscopes, compasses, barometers, fingerprint sensors, facial recognition systems, RF sensors (for example, Wi-Fi and cellular radios), thermal sensors, or other types of sensors. For example, the cameras can include a forward- or rear-facing camera with movable or fixed lenses, a flash, an image sensor, and an image processor. The camera can be a megapixel camera capable of capturing details for facial and/or iris recognition. The camera along with a data processor and authentication information stored in memory or accessed remotely can form a facial recognition system. The facial recognition system or one-or-more sensors, for example, microphones, motion sensors, accelerometers, GPS sensors, or RF sensors, can be used for user authentication.

To provide for interaction with a user, embodiments can be implemented on a computer having a display device and an input device, for example, a liquid crystal display (LCD) or organic light-emitting diode (OLED)/virtual-reality (VR)/augmented-reality (AR) display for displaying information to the user and a touchscreen, keyboard, and a pointing device by which the user can provide input to the computer. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments can be implemented using computing devices interconnected by any form or medium of wireline or wireless digital data communication (or combination thereof), for example, a communication network. Examples of interconnected devices are a client and a server generally remote from each other that typically interact through a communication network. A client, for example, a mobile device, can carry out transactions itself, with a server, or through a server, for example, performing buy, sell, pay, give, send, or loan transactions, or authorizing the same. Such transactions may be in real time such that an action and a response are temporally proximate; for example an individual perceives the action and the response occurring substantially simultaneously, the time difference for a response following the individual's action is less than 1 millisecond (ms) or less than 1 second (s), or the response is without intentional delay taking into account processing limitations of the system.

Examples of communication networks include a local area network (LAN), a radio access network (RAN), a metropolitan area network (MAN), and a wide area network (WAN). The communication network can include all or a portion of the Internet, another communication network, or a combination of communication networks. Information can be transmitted on the communication network according to various protocols and standards, including Long Term Evolution (LTE), 5G, IEEE 802, Internet Protocol (IP), or other protocols or combinations of protocols. The communication network can transmit voice, video, biometric, or authentication data, or other information between the connected computing devices.

Features described as separate implementations may be implemented, in combination, in a single implementation, while features described as a single implementation may be implemented in multiple implementations, separately, or in any suitable sub-combination. Operations described and claimed in a particular order should not be understood as requiring that the particular order, nor that all illustrated operations must be performed (some operations can be optional). As appropriate, multitasking or parallel-processing (or a combination of multitasking and parallel-processing) can be performed

What is claimed is:

1. A computer-implemented method, comprising:

obtaining, by a user terminal, an audio signal;

determining a ratio of a sampling rate of a predetermined voice signal to a frequency of the predetermined voice signal;

dividing, by the user terminal, the audio signal into a maximum quantity of short-time energy frames containing a plurality of samples based on the ratio;

determining, by the user terminal, energy of each short-time energy frame; and determining, by the user terminal, whether the audio signal includes a voice signal based on the energy of each short-time energy frame.

2. The computer-implemented method of claim 1, wherein the audio signal is collected at the sampling rate and is in a pulse code modulation (PCM) format.

3. The computer-implemented method of claim 1, wherein the obtained audio signal is in a non-PCM format, and further comprising:

prior to dividing the audio signal:

converting the audio signal into a pulse code modulation (PCM) format; and identifying the sampling rate of the audio signal.

4. The computer-implemented method of claim 1, wherein the energy of each short-time energy frame is a sum of energy associated with each sampling point in each short-time energy frame, and wherein the energy associated with each sampling point is determined based on an amplitude of the audio signal that corresponds to the sampling point in the short-time energy frame.

5. The computer-implemented method of claim 1, wherein determining whether the audio signal includes a voice signal comprises:

determining a plurality of high-energy frames, wherein each high-energy frame of the plurality of high-energy frames is a short-time energy frame where energy is greater than a predetermined threshold;

determining a high-energy frame ratio that is represented by a ratio of a quantity of the plurality of high-energy frames to a quantity of the short-time energy frames included in the audio signal;

determining whether the high-energy frame ratio is greater than a predetermined value;

if it is determined that the high-energy frame ratio is greater than the predetermined value:

determining that the audio signal includes a voice signal; or if it is determined that the high-energy frame ratio is not greater than the predetermined value:

determining that the audio signal does not include a voice signal.

6. The computer-implemented method of claim 5, wherein it is determined that the high-energy frame ratio is greater than the predetermined value, further comprising:

determining, from the short-time energy frames included in the audio signal, whether there exist a predetermined number of consecutive short-time energy frames, wherein each of the predetermined number of consecutive short-time energy frame has energy that is greater than the predetermined threshold;

if YES, determining that the audio signal includes a voice signal; or otherwise, determining that the audio signal does not include a voice signal.

7. A non-transitory, computer-readable medium storing one or more instructions executable by a computer system to perform operations comprising:

obtaining, by a user terminal, an audio signal;

determining a ratio of a sampling rate of a predetermined voice signal to a frequency of the predetermined voice signal;

dividing, by the user terminal, the audio signal into a maximum quantity of short-time energy frames containing a plurality of samples based on the ratio;

determining, by the user terminal, energy of each short-time energy frame; and determining, by the user terminal, whether the audio signal includes a voice signal based on the energy of each short-time energy frame.

8. The non-transitory, computer-readable medium of claim 7, wherein the audio signal is collected at the sampling rate and is in a pulse code modulation (PCM) format.

9. The non-transitory, computer-readable medium of claim 7, wherein the obtained audio signal is in a non-PCM format, and further comprising:

prior to dividing the audio signal:

converting the audio signal into a pulse code modulation (PCM) format; and identifying the sampling rate of the audio signal.

10. The non-transitory, computer-readable medium of claim 7, wherein the energy of each short-time energy frame is a sum of energy associated with each sampling point in each short-time energy frame, and wherein the energy associated with each sampling point is determined based on an amplitude of the audio signal that corresponds to the sampling point in the short-time energy frame.

11. The non-transitory, computer-readable medium of claim 7, wherein determining whether the audio signal includes a voice signal comprises:

determining a plurality of high-energy frames, wherein each high-energy frame of the plurality of high-energy frames is a short-time energy frame where energy is greater than a predetermined threshold;

determining a high-energy frame ratio that is represented by a ratio of a quantity of the plurality of high-energy frames to a quantity of the short-time energy frames included in the audio signal;

determining whether the high-energy frame ratio is greater than a predetermined value;

if it is determined that the high-energy frame ratio is greater than the predetermined value:

determining that the audio signal includes a voice signal; or if it is determined that the high-energy frame ratio is not greater than the predetermined value:

determining that the audio signal does not include a voice signal.

12. The non-transitory, computer-readable medium of claim 11, wherein it is determined that the high-energy frame ratio is greater than the predetermined value, further comprising:

determining, from the short-time energy frames included in the audio signal, whether there exist a predetermined number of consecutive short-time energy frames, wherein each of the predetermined number of consecutive short-time energy frame has energy that is greater than the predetermined threshold;

if YES, determining that the audio signal includes a voice signal; or otherwise, determining that the audio signal does not include a voice signal.

13. A computer-implemented system, comprising:

one or more computers; and one or more computer memory devices interoperably coupled with the one or more computers and having tangible, non-transitory, machine-readable media storing one or more instructions that, when executed by the one or more computers, perform one or more operations comprising:

obtaining, by a user terminal, an audio signal;

determining a ratio of a sampling rate of a predetermined voice signal to a frequency of the predetermined voice signal;

dividing, by the user terminal, the audio signal into a maximum quantity of short-time energy frames containing a plurality of samples based on the ratio;

determining, by the user terminal, energy of each short-time energy frame; and determining, by the user terminal, whether the audio signal includes a voice signal based on the energy of each short-time energy frame.

14. The computer-implemented system of claim 13, wherein the audio signal is collected at the sampling rate and is in a pulse code modulation (PCM) format.

15. The computer-implemented system of claim 13, wherein the obtained audio signal is in a non-PCM format, and further comprising:

prior to dividing the audio signal:

converting the audio signal into a pulse code modulation (PCM) format; and identifying the sampling rate of the audio signal.

16. The computer-implemented system of claim 13, wherein the energy of each short-time energy frame is a sum of energy associated with each sampling point in each short-time energy frame, and wherein the energy associated with each sampling point is determined based on an amplitude of the audio signal that corresponds to the sampling point in the short-time energy frame.

17. The computer-implemented system of claim 13, wherein determining whether the audio signal includes a voice signal comprises:

determining a plurality of high-energy frames, wherein each high-energy frame of the plurality of high-energy frames is a short-time energy frame where energy is greater than a predetermined threshold;

determining a high-energy frame ratio that is represented by a ratio of a quantity of the plurality of high-energy frames to a quantity of the short-time energy frames included in the audio signal;

determining whether the high-energy frame ratio is greater than a predetermined value;

if it is determined that the high-energy frame ratio is greater than the predetermined value:

determining that the audio signal includes a voice signal; or if it is determined that the high-energy frame ratio is not greater than the predetermined value:

determining that the audio signal does not include a voice signal.

* * * * *